US005131775A

United States Patent [19]

Chen

[11] Patent Number: 5,131,775

[45] Date of Patent: Jul. 21, 1992

[54] RETRACTABLE PEN WITH ILLUMINATION MEANS

[76] Inventor: Chuang-Yi Chen, 3 Fl., No. 1174, Cheng Teh Rd., Taipei, Taiwan

[21] Appl. No.: 739,685

[22] Filed: Aug. 2, 1991

[51] Int. Cl.[5] ..... B43K 29/10

[52] U.S. Cl. ..... 401/195; 401/52; 362/118

[58] Field of Search ..... 401/52, 195, 192; 362/118-120

[56] References Cited

U.S. PATENT DOCUMENTS

| | | | |
|---|---|---|---|
| 1,216,862 | 2/1917 | Sickles | 362/118 |
| 1,649,656 | 11/1927 | Bischoff | 362/118 |
| 1,722,238 | 7/1929 | Weber | 362/118 |
| 1,878,431 | 9/1932 | Turton | 362/118 |
| 2,651,709 | 9/1953 | Ross et al. | 401/195 |
| 3,303,337 | 2/1967 | Lo | 362/118 |
| 4,028,540 | 6/1977 | Key | 362/118 |
| 4,964,024 | 10/1990 | Tsay | 362/118 |

FOREIGN PATENT DOCUMENTS

| | | | |
|---|---|---|---|
| 1040172 | 5/1953 | France | 362/118 |

*Primary Examiner*—Danton D. DeMille
*Attorney, Agent, or Firm*—Patterson & Keough

[57] ABSTRACT

A retractable pen with illumination means has coaxial upper and lower barrel members which consist of a conductive body. A conductor element and a light-emitting diode having two chips are fitted in the front part of the lower barrel member. The chips of the light-emitting diode are arranged on symmetrically sides of the writing tip. When the reservoir tube is fitted in the upper and lower barrel members, the conductor element is connected with cells placed in the rear end of the upper barrel member; thus, the light-emitting diode illuminates evenly.

6 Claims, 5 Drawing Sheets

RETRACTABLE PEN WITH ILLUMINATION MEANS

BACKGROUND OF THE INVENTION

The present invention relates to a retractable pen with illumination means which is able to illuminate a writing surface in the dark.

Conventional writing implements usually do not possess illumination means, or possessing illumination means, but are large and provide uneven illumination.

It is the purpose of this present invention, therefore, to mitigate and/or obviate the above-mentioned drawbacks in the manner set forth in the detailed description of the preferred embodiment.

SUMMARY OF THE INVENTION

It is an object of the present invention to provide a retractable pen with illumination means which is able to illuminate a writing surface in the dark, which comprises a light-emitting diode (LED) having two chips and a conductor element fitted in the front end of a lower barrel member of the pen. The chips of the light-emitting diode are arranged symmetrically on sides of a writing tip. When a reservoir tube is fitted in an upper and the lower barrel member, the conductor element is connected with power cells placed in the rear end of the upper barrel member, and therefore, the light-emitting diode will illuminate evenly.

This and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
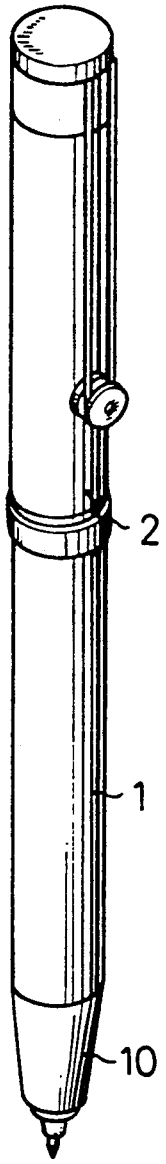
FIG. 1 is a perspective view of a retractable pen in accordance with the present invention.
Figure 2:
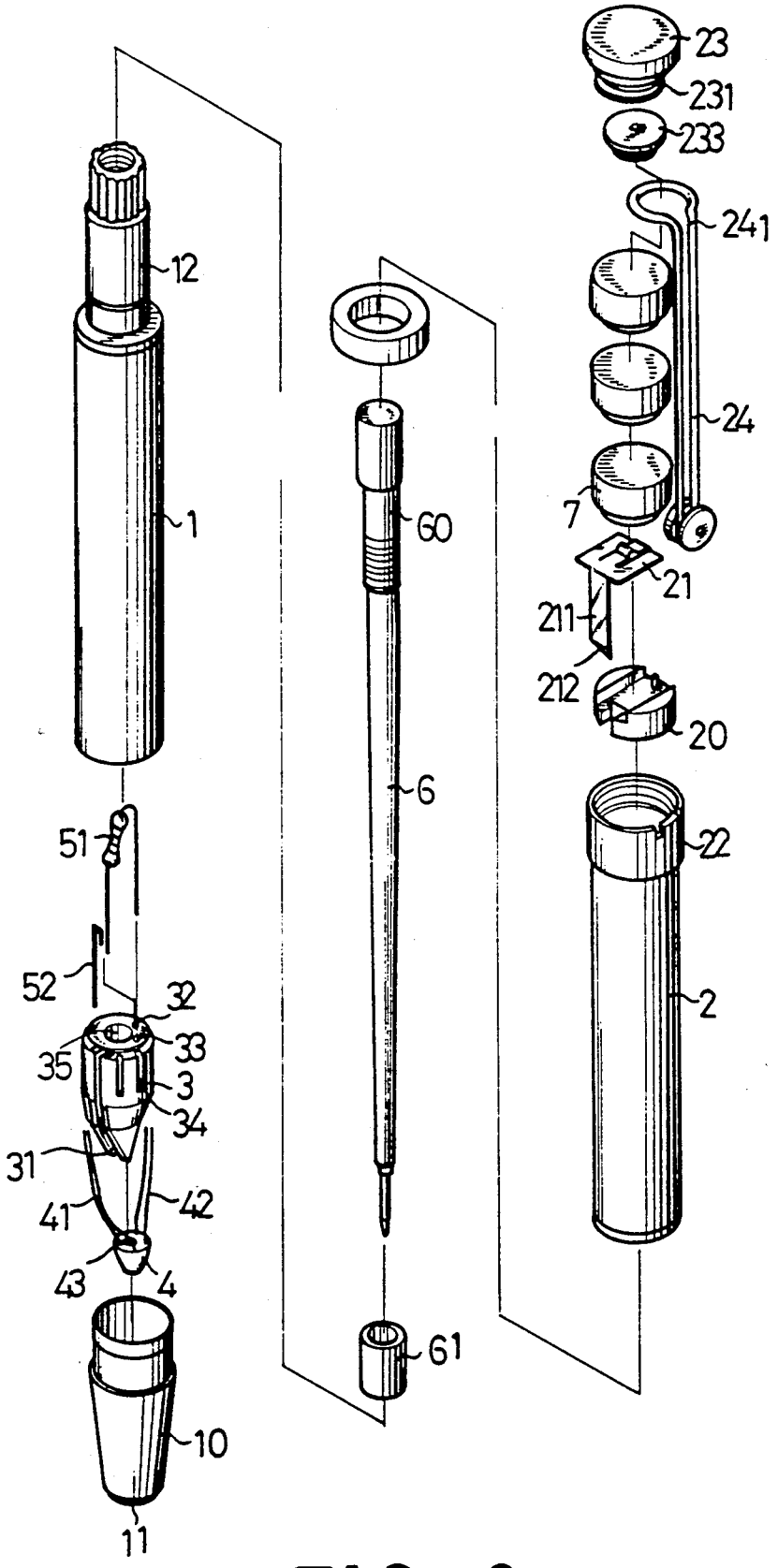
FIG. 2 is an exploded perspective view thereof.
Figure 3:
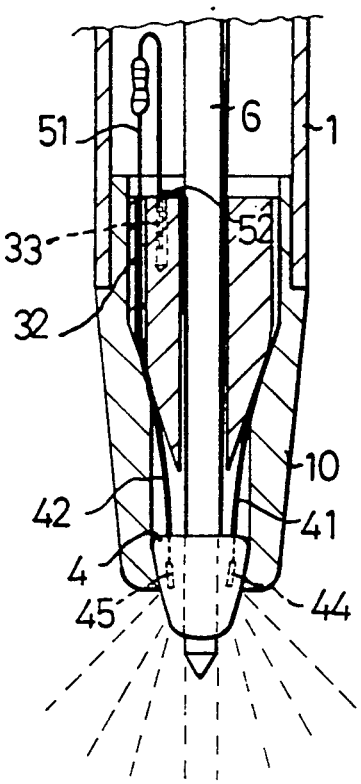
FIG. 3 is a partial, longitudinal cross-sectional view showing a front end of the retractable pen.

Referring to FIGS. 1 and 2, the retractable pen of the present invention comprises a lower barrel member 1 and an upper barrel member 2 which consist of a conductive body, and a reservoir tube 6. The lower barrel member 1 is tubular-shaped and has a coupling part 12 on front end thereof. The tapered end element 10 has an opening 11 on a tip thereof. Inside the tapered end element 10 is a conductor element 3 and a light-emitting diode 4. The conductor element is cone-shaped and comprises a plurality of slots 34 on a periphery thereof, so as to tightly join the conductor element 3 to the tapered end element 10. The conductor element 3 further comprises two triangular plates 31 on a top thereof, a penetrating hole 32, a hole 33, and a central penetrating hole 35. The diode 4 comprises a central penetrating hole 43, which corresponds to the penetrating hole 35 of the conductor element 3, and two chips 44 and 45 installed on respective sides of the penetrating hole 43. Pins of the chips 44 and 45 having like electrodes connected to form two pairs of pins 41 and 42. Pins 41 contact an outside of the conductor element 3 and an inner wall of the tapered end element 10, while pins 42 penetrates the penetrating hole 32. One pin of a resistor 51 inserts in the penetrating hole 32 to contact the pins 42. The other pin of the resistor 51 and one end of a conducting strip 52 insert in the hole 33, while the other end of the conducting strip 52 inserts in the central penetrating hole 35 of the conductor element 3, as shown in FIG. 3.

Inside the upper barrel member 2 is a spacer 20 and a conducting plate 21. The conducting plate 21 comprises a convex portion on a surface thereof and a downward extending part 211. Formed on a rear part of the reservoir tube 6 are a conducting part 60 and an insulating part 61. The reservoir tube 6 is screwed into the coupling part 12 of the lower barrel member 1. The coupling part 12 is fitted in the front end of the upper barrel member 2. The reservoir tube 6 can thus move longitudinally by rotating the upper barrel member 2, in a similar fashion as conventional retractable pens do. Formed on a rear end of the upper barrel member 2 is an end plate 22 having a cover 23 screwed thereon. The cover 23 comprises threading 231. The ring portion 241 of a clip 24 is fitted over the threading 231. A spring 233 and mercury cells 7 are placed between the cover 23 and the conducting plate 21.

Figure 4:
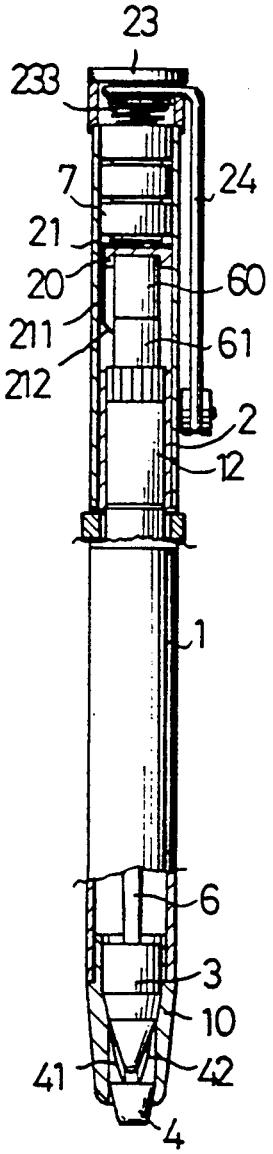
FIG. 4 is a cut-away cross-sectional view of the retractable pen of FIG. 1 in a condition prior to use.
Figure 5:
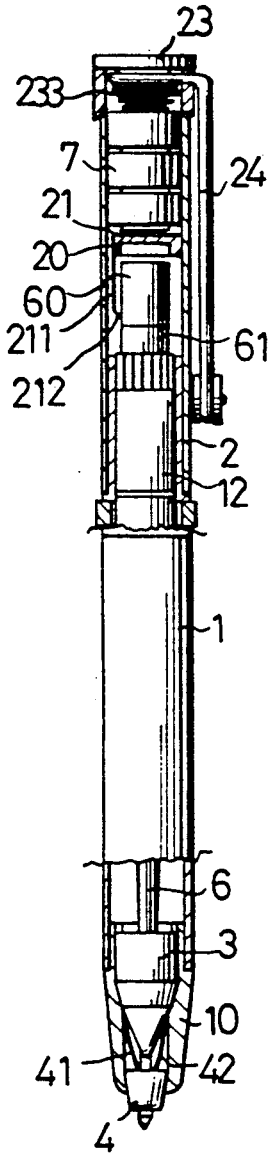
FIG. 5 is a view similar to FIG. 4, but showing the pen in use.

As shown in FIG. 4, the retractable pen of the present invention is in a condition prior to use. The downward extending part 211 of the conducting plate 21 contacts the insulating part 61 of the reservoir tube 6; thus, the circuit is open and the light-emitting diode 4 does not illuminate. Referring to FIG. 5, showing the retractable pen of the present invention in use, the reservoir tube 6 is moved downward by rotating the upper barrel member 2, and the downward extending part 211 contacts the conducting part 60. Thus, the current goes from the cells 7, through the conducting plate 21, conducting part 60 of the reservoir tube 6, the reservoir tube 6, the conducting strip 52, the resistor 51, the pins 42, the chips 45 and 44, the pins 41, the lower barrel member 1, the upper barrel member 2, the end plate 22, the cover 23, and the spring 233, then backs to the cells 7, so that the circuit is closed and the light-emitting diode 4 illuminates.

Because the two chips of the light-emitting diode 4 are placed symmetrically on sides of the writing tip, the light will illuminate evenly around the writing tip.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A retractable pen comprising:

a reservoir tube comprising an insulating part and a conducting part;

a lower barrel member comprising a coupling part; a tapered end element fitted on a front end thereof, said tapered end element having an opening on a tip thereof; and a conducting and illuminating unit being arranged inside the tapered end element;

an upper barrel member comprising an end plate on a rear end thereof; a cover having threading screwed on said end plate; and a supply unit being arranged inside said upper barrel member, said supply unit comprising a conducting plate; and said reservoir tube being fitted in said coupling part of said lower barrel member, said coupling part being fitted in said front end of said upper barrel member, so that by rotating said upper barrel member, said conducting plate of said supply unit contacts said conducting part of said reservoir tube, thereby closing a circuit formed thereby and illuminating said conducting and illuminating unit.

2. A retractable pen as claimed in claim 1, wherein said conducting and illuminating unit comprises a conductor element, a light-emitting diode, a conducting strip, and a resistor.

3. A retractable pen as claimed in claim 2, wherein said supply unit comprises a spacer, a plurality of cells, and a spring.

4. A retractable pen as claimed in claim 3, wherein said conducting plate of said supply unit comprising a convex portion on a surface thereof and a downward extending part.

5. A retractable pen as claimed in claim 4, wherein said conductor element of said conducting and illuminating unit comprises a plurality of slots on a periphery thereof; and said conductor element further comprises two triangular plates on a top thereof, a hole, a penetrating hole, and a central penetrating hole.

6. A retractable pen as claimed in claim 5, wherein said light-emitting diode of said conducting and illuminating unit comprises a central penetrating hole, which corresponds to said central penetrating hole of said conductor element; and two chips installed on respective sides of said penetrating hole of said light-emitting diode, pins of said chips having like electrodes connected to form two pairs of pins, one pair of pins contacts an outside of said conductor element and an inner wall of said tapered end element, the other pair of pins penetrates said penetrating hole of said conductor element, one pin of said resistor inserts in said penetrating hole, the other pin of said resistor and one end of said conducting strip inserts in said hole of said conductor element, and the other end of said conducting strip inserts in said central penetrating hole of said conductor element.

* * * * *